United States Patent [19]

Baker

[11] Patent Number: 4,934,125

[45] Date of Patent: Jun. 19, 1990

[54] A METHOD OF FILLING A CONTAINER

[75] Inventor: Barry P. Baker, Down, Great Britain

[73] Assignee: Gallaher Limited, Surrey, England

[21] Appl. No.: 324,975

[22] Filed: Mar. 20, 1989

Related U.S. Application Data

[63] Continuation of Ser. No. 108,053, Oct. 13, 1987, abandoned.

[30] Foreign Application Priority Data

Oct. 13, 1986 [GB] United Kingdom ..... 8624480
Jan. 13, 1987 [GB] United Kingdom ..... 8700705
Sep. 16, 1987 [GB] United Kingdom ..... 8721745

[51] Int. Cl.[5] ..... B65B 1/24; B65B 7/06; B65B 63/02

[52] U.S. Cl. ..... 53/436; 53/469; 53/527; 206/242

[58] Field of Search ..... 53/390, 436, 469, 473, 53/527; 131/327, 111, 112; 150/52 R, 52 F; 206/242, 835, 810; 383/24, 97, 117

[56] References Cited

U.S. PATENT DOCUMENTS

| | | | |
|---|---|---|---|
| 206,976 | 8/1878 | Sands | 150/52 R |
| 247,544 | 9/1881 | Dieterichs | 53/436 X |
| 723,245 | 3/1903 | Cranz et al. | 206/242 |
| 1,413,868 | 4/1922 | O'Bryan et al. | 131/112 X |
| 1,557,881 | 10/1925 | Rogers | 206/83.5 |
| 1,981,774 | 11/1934 | Blitz | 150/52 |
| 2,344,861 | 3/1944 | Fowler | 206/310 X |
| 2,763,973 | 9/1956 | Atkins | 53/436 |
| 3,189,074 | 6/1965 | Schaefer | 150/52 R |
| 3,252,737 | 5/1966 | Seaton | 53/436 X |
| 3,405,744 | 10/1968 | Bowman | 53/436 X |
| 3,439,865 | 4/1969 | Port et al. | 383/117 |
| 3,660,150 | 5/1972 | Cooper | 383/117 X |
| 3,797,650 | 3/1974 | O'Brien et al. | 150/52 R X |
| 3,808,766 | 5/1974 | Hutchinson et al. | 53/436 |
| 3,827,210 | 8/1974 | Smalley et al. | 53/436 X |
| 4,204,565 | 5/1980 | Nohmura | 383/97 X |
| 4,207,937 | 6/1980 | Sandeman et al. | 383/117 X |
| 4,479,243 | 10/1984 | Derby et al. | 383/24 |

FOREIGN PATENT DOCUMENTS

| | | |
|---|---|---|
| 1063523 | 8/1959 | Fed. Rep. of Germany . |
| 1205446 | 11/1965 | Fed. Rep. of Germany . |
| 946466 | 1/1964 | United Kingdom . |

OTHER PUBLICATIONS

"Test Marketing of Looseleaf Tobacco Begun" by John Cyrus Tobacco, p. 17 and 24, 6/30/1967, class 131/327.

*Primary Examiner*—John Sipos
*Assistant Examiner*—Beth Bianca
*Attorney, Agent, or Firm*—Jeffers, Hoffman & Niewyk

[57] ABSTRACT

A container for transporting a compressed block of tobacco (18) comprises rectangular bottom top front rear and two side walls (2,4,1,3,5,6) which are formed of pliable sheets of non-shape sustaining fabric, such as woven polypropylene. The top wall (4) is connectable by a sliding clasp fastener (9,10,11,12) along three of its edges to the adjacent upper edges of adjacent walls.

3 Claims, 2 Drawing Sheets

Fig. 2.
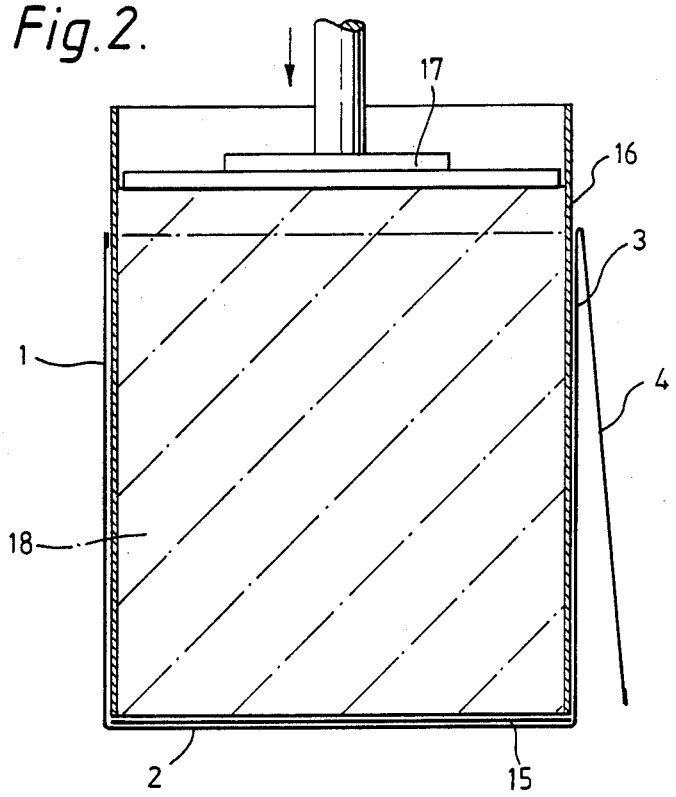
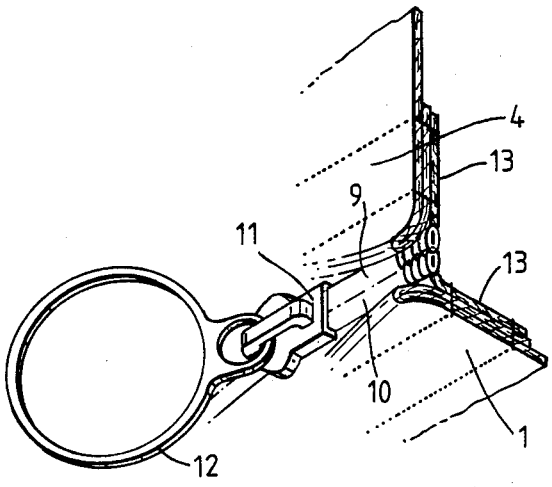
Fig. 3.

A METHOD OF FILLING A CONTAINER

This is a continuation of application Ser. No. 108,053, filed Oct. 13, 1987 now abandoned.

The invention relates to containers for use in transporting tobacco, such as raw tobacco leaf or reconstituted tobacco, e.g. from the country of origin to the country of finished product manufacture.

Traditionally, raw tobacco leaf is heated and made pliable in the presence of steam, and while in this state, it is fed into an hydraulic press which compresses a column of leaf from about 1000 cm down to about 70 cm into a cardboard carton. The press works over an empty carton containing a steel sleeve or corset. When the press head returns on its up stroke the sleeve is removed and the flaps of the carton are closed, and the carton strapped. The tobacco is then often impregnated with a gaseous fumigant.

Such cardboard cartons need external strapping, because the tobacco tries to spring up before it has cooled. This strapping step is time consuming and adds additional cost to that of the carton. The cartons are inherently vulnerable to damage, particularly when wet, during handling, e.g. by a fork lift truck, or by being partially collapsed when stacked owing to shrinkage of the contents. As a result they are only expected to make one journey.

GB-A-946466 discloses a protective container having a bottom wall incorporating a pallet and connectable to integral front, side, rear and top walls by a sliding clasp fastener. This would not be suitable for the present purpose; there is no indication as to how the upper part of the container is fabricated; and its walls are apparently vapour proof.

In accordance with the present invention a container for a compressed block of tobacco comprises rectangular bottom, top, front, rear and two side walls, of which at least the front, rear and side walls are formed of pliable sheets of non-shape sustaining fabric; and the top wall being connectable by a sliding clasp fastener along at least three of its edges to the adjacent upper edges of adjacent walls.

A container of this construction may be filled beneath an hydraulic press in a substantially conventional manner. When the press head has been withdrawn, the top wall, forming a hinged lid of the container, is closed quickly, before the tobacco has expanded upwards above the upper edges of the front, rear and side walls, and secured by means of the sliding clasp fastener. The tendency for the compressed tobacco to expand, i.e. upwards and downwards in the direction of compression, is best resisted if the top, rear, bottom and front walls are formed by a continuous web of the fabric, and the side walls are stitched along their edges to the edges of the rear, bottom and front walls. As there is minimal tendency for the tobacco to expand sideways, the stiched seams are then protected against possible splitting. Surprisingly, such a container, provided that it is made of appropriate fabric, such as woven polypropylene fabric, effectively forms a shrink wrapping for a block of compressed tobacco and may be reused many times, as it is virtually indestructable when handled. In particular, it may be returned for refilling in a completely collapsed state in which it occupies minimum volume.

Provided that the container walls are sufficiently porous, the filled container may be fumigated by passing a gaseous fumigant through the walls into the tobacco. A closely woven polypropylene fabric is suitably gas-permeable but reasonably waterproof so that the contents are not unduly wetted if the containers are stood in the rain or on a wet surface. Better water impermeability may be achieved by making the container walls from a two ply laminate, of which the outer ply is of wear resistant tough material, such as woven polypropylene, and the inner ply is of a less durable layer of, e.g., an integrated coating of polypropylene, which is gas-permeable, but not liquid-permeable.

The outer ply of polypropylene fabric may have a weight of between 225 and 275 g/sq m woven from warp and weft yarn of between 1800 and 2200 denier. The inner ply may then be provided by an integrated coating of polypropylene with a weight of between 36 and 44 g/sq m. The stitching may use polypropylene thread of between 4500 and 5500 denier.

Bale boards, made for example of wood or cardboard, may be used in the top and/or bottom of the container, to provide some support when the filled containers are stacked on their front or rear walls, but these will not prevent complete collapse of the container when empty, particularly if the bale boards are removable.

A typical container in accordance with the present invention will have a length of at least 80 cm, preferably of the order of 110 cm, a width of at least 50 cm, preferably of the order of 75 cm, and a height of at least 35 cm, preferably at least 50 cm, most preferably of the order of 75 cm. A container with the above preferred dimensions, will be capable of containing a block of tobacco with a weight of the order of 200 kg.

An example of a container constructed in accordance with the present invention is illustrated in the accompanying drawings, in which:

FIG. 2 is a diagrammatic section showing the container being filled; and,

FIG. 3 is a perspective detail showing the sliding clasp fastener.

Figure 1:
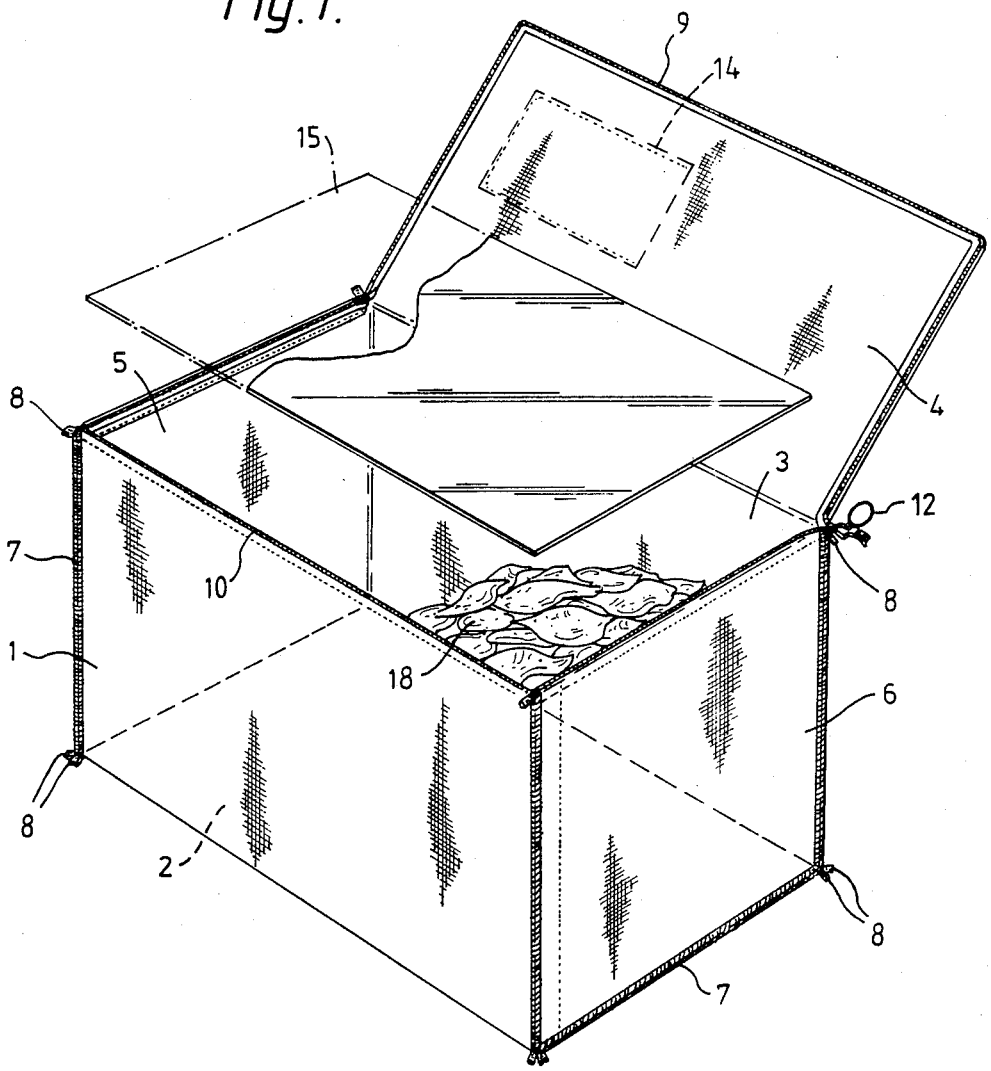
FIG. 1 is an exploded perspective view showing a container filled but open.

The illustrated container has a front wall 1, a bottom wall 2, rear wall 3, and top wall 4 formed by a continuous web of flexible woven polypropylene, which is 110 cm wide. The container also has square side walls 5 and 6 of similar material, and with a side of 70 cm. The polypropylene fabric is a double ply, of which the outer ply has a weight of 250 g/sq m and is woven from warp and weft yarn of 2000 denier, and of which the inner ply is an integrated coating of polypropylene film with a weight of 40 g/sq m. The inner ply of polypropylene film may be applied to the outer ply of woven polypropylene by a process involving high temperature and vacuum, so that the inner ply is drawn into the interstices of the woven ply and is fused to, and thus integrated with, it. This fabric is waterproof but sufficiently gas-permeable for it to be possible to pass a gaseous fumigant under pressure through the container walls into its contents. The side walls 5 and 6 are secured to the web by blanket stitching 7 using polypropylene thread of 5000 denier. The ends of the threads extend at the upper and lower corners of the container and are sealed by crimped cleats 8.

The three free edges of the top wall 4 are provided with one part 9, and the upper edges of the walls 5, 1 and 6 are provided with the other part 10, of a sliding clasp fastener having a sliding clasp 11 with a pull ring 12. The sliding clasp fastener is preferably one having opposed sets of interengaging teeth, such as that sold under the identification "No. 10 zip". This has tapes 13 21 mm wide which have been waterproofed. The tapes of the fastener are attached to the container walls and top by 13 metric nylon thread. The sliding clasp of the fastener is fitted with the ring 12 for easy pulling when the container must be quickly closed after the compression of the tobacco filling has been released.

The tapes at the trailing end of the fastener extend outside the plan of the container so that when the fastener is fully undone the top can be folded completely back to expose the full plan area of the container.

One of the walls, such as the top wall 4, of the container, may have on its outer side a transparent open ended pouch 14 for receiving an identification document. The container is also optionally provided with upper and lower bale boards 15.

The container may be transported empty in a substantially completely flat configuration, after folding the walls 5 and 6 inwardly, the walls 1 and 3 downwardly on to the bottom wall 2 and the top wall 4 folded back over the wall 3. In this configuration, provided that any bale boards 15 have been removed, the container can even be rolled up and secured with a spring or band.

When used, for example in conjunction with a filling sleeve 16 and press 17, as shown in FIG. 2, the empty container, with the top wall 4, forming the lid, folded back, is drawn up over the bottom of the sleeve 16, utilizing handles (not shown), optionally with the bale board 15 in position. A column of loose tobacco 18 in the sleeve 16 is then compressed downwardly to the height of the top of the container, using the press 17. Thereafter the sleeve 16 is drawn out of the filled container. After the optional insertion of the bale board 15, the top wall 4 is then folded down and secured by mean of the sliding clasp fastener 9–12.

The container may then be fumigated, prior to transportation, in conventional manner, so that gaseous fumigant passes through the container walls and impregnates the block of tobacco.

I claim:

1. A method of filling a reuseable container with a stack of tobacco comprising:

providing an empty container comprising interconnected rectangular bottom, top, front, rear and two side walls, of which at least said front, rear and side walls are formed of pliable sheets of non-shape retaining fabric comprising woven polypropylene, the container having a length between its side walls of at least 80 cm, a width of at least 50 cm and a height of at least 35 cm, three of said front, rear and side walls having free upper edges and the remaining said front, rear or side wall being connected to the top wall, the top wall being folded outwardly to thereby open said container;

placing the empty container with its open top beneath a press and inserting a sleeve into the container such that the sleeve extends closely within the front, rear and side walls and down substantially to the bottom wall of the container;

operating the press to compress a stack of tobacco downwards into the sleeve and container;

removing the sleeve from the filled container;

withdrawing the press from the filled container;

folding the top wall over the compressed stack of tobacco within the container; and starting a slide clasp at a position near where the top wall is connected to said remaining front, rear or side wall and pulling the slide clasp along three edges of said top wall and along adjacent said upper free edges of said three walls to secure the top wall to said three walls.

2. The method of claim 1 wherein the container top, rear, bottom and front walls are formed by a continuous web of the fabric, and the side walls are stitched along edges thereof to edges of the rear, bottom and front walls.

3. The method of claim 1 wherein the polypropylene fabric has a weight of between 225 and 275 g/sq m woven from warp and weft yarn of between 1800 and 2200 denier.

* * * * *